US006501467B2

(12) United States Patent
Miyazaki

(10) Patent No.: US 6,501,467 B2
(45) **Date of Patent: *Dec. 31, 2002**

(54) LIQUID-CRYSTAL DISPLAY PANEL DRIVE POWER SUPPLY CIRCUIT

(75) Inventor: Kiyoshi Miyazaki, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,377

(22) Filed: Jun. 4, 1999

(65) Prior Publication Data

US 2002/0171641 A1 Nov. 21, 2002

(30) Foreign Application Priority Data

Jun. 8, 1998 (JP) ..... 10-158917

(51) Int. Cl.[7] ..... G09G 5/00
(52) U.S. Cl. ..... 345/210; 345/87; 345/95
(58) Field of Search ..... 345/211, 204, 345/87, 95, 210

(56) References Cited

U.S. PATENT DOCUMENTS 5,854,627 A * 12/1998 Kurihara et al. ..... 345/211
5,859,632 A * 1/1999 Ito ..... 345/211
6,144,373 A * 11/2000 Nakazawa et al. ..... 345/204
6,188,395 B1 * 2/2001 Yatabe ..... 345/211
6,256,025 B1 * 7/2001 Imai et al. ..... 345/211

FOREIGN PATENT DOCUMENTS

| | | |
|---|---|---|
| JP | 62-83724 | 4/1987 |
| JP | 02-150819 | 6/1990 |
| JP | 5-257121 | 10/1993 |
| JP | 05-313595 | 11/1993 |
| JP | 05-346771 | 12/1993 |
| JP | 6-324640 | 11/1994 |
| JP | 09-101828 | 4/1997 |
| JP | 10-11026 | 1/1998 |
| JP | 10-31200 | 2/1998 |
| JP | 10-198446 | 7/1998 |

* cited by examiner

*Primary Examiner*—Dennis-Doon Chow
*Assistant Examiner*—Uchendu O. Anyaso
(74) *Attorney, Agent, or Firm*—Sughrue Mion, PLLC

(57) ABSTRACT

In a liquid-crystal display panel drive power supply circuit that has a first power supply of a high potential, a second powers supply of a potential that is lower than that of the first power supply, a plurality of resistors that are provided in series between the first and second power supplies, and a plurality of voltage-follower configured amplifiers for the purpose of introducing mutually different voltages present at the connection points between the resistors to a liquid-crystal panel, capacitors are inserted between the output terminals of the amplifiers and the second power supply.

5 Claims, 10 Drawing Sheets

CASE OF ALTERNATING DISPLAYED AND NON-DISPLAYED PIXELS

LOAD DRIVE POERATION IN THE PRIOR ART (FRAME 2)

LOAD DRIVE OPERATION ACCORDING TO THE PRESENT INVENTION (FRAME 2)

LOAD DRIVE OPERATION ACCORDING TO THE PRESENT INVENTION (FRAME 1)

LIQUID-CRYSTAL DISPLAY PANEL DRIVE POWER SUPPLY CIRCUIT

BACKGROUND OF THE INVENTION

1. Field of the Invention

The present invention relates to an liquid-crystal display panel drive power supply and to a method for reducing the power consumption of this liquid-crystal display panel drive power supply.

2. Description of the Related Art

In recent years, with the widespread use of liquid-crystal display panels in portable electronic equipment, there has been a demand for lower power consumption in a power supply for liquid-crystal displays and for an improvement in the output impedance of a power supply to accommodate a large liquid crystal panel for display of special characters. FIG. 6 shows a block diagram that includes a liquid-crystal display panel and the peripheral drive circuitry therefore. The display panel M4 is formed by sandwiching a liquid crystal between two glass electrodes that have a multitude of parallel wires such that the electrode lines are mutually perpendicular.

Of the two electrodes, a first electrode, the common (COM) electrodes, are usually taken from the lateral direction of the panel, and the second electrodes, the segment (SEG) or data electrodes, are usually taken from the vertical direction.

The points at which the common electrode intersects with the segment electrode with the liquid crystal therebetween form an equivalent capacitance (hereinafter referred to as a pixel capacitance), and by applying a prescribed potential difference between each of the common and segment electrodes, a potential is applied to corresponding pixel capacitance, resulting in display of that pixel. Therefore, by selecting the potential of the segment electrodes in accordance with display data while scanning (selecting) the common electrodes, it is possible to display data. The selection circuit M2, the common driver M3, and the segment driver M5 are basically formed by analog MOS switches, a prescribed level of power supply circuit M1 being selected in accordance with the scanning and data display timing, so as to apply voltages to the electrodes of the liquid-crystal panel. FIG. 7 shows an example of output waveforms for the case in which the voltages V1 to V5 which are generated by the level power supply circuit =M1 of FIG. 6 and VEE (ground) are output by the common driver M3 and the segment driver M5. The segment driver M5 outputs as a selected level (V1 or ground) or non-selected level (V3 or V4) in accordance with the existence or non-existence of data. Because when the voltages which is applied to a liquid crystal are applied in a DC manner, the deterioration of the liquid crystal is accelerated, in general the selected and non-selected levels are varied with a given period, so that they are applied as AC levels. FIG. 7 is an example in which selected level and non-selected level are changed for each common scan, this being known as the frame reversal mode. For this reason, driving a liquid crystal requires the use of a multilevel power supply. However, with the use of liquid-crystal displays in portable equipment, it is also necessary for the liquid-crystal display power supply to have low power consumption. Because of this need, a circuit such as shown in FIG. 9 was used in the past as a power supply circuit. In FIG. 9, to limit wasteful power consumption other than for driving the liquid-crystal, voltage-dividing resistors R1 through R5 are established with resistance values in the range from several tens of kilohms to several hundreds of kilohms, thereby limiting the current flowing in the idling condition.

However, if the output impedance is high, driving a liquid crystal, which represents a capacitive load, results in waveform distortion, this resulting in a deterioration of display quality. Because of this, the divided voltages are output via amplifiers (B1 through B5), so that there is an improvement in the charging capacity and discharging capacity at the voltage levels required for liquid crystal drive. However, in order to limit the increase of current consumption caused by the use of amplifiers, an external bias is used with each amplifier to limit the bias current, thereby limiting internal current and unnecessary current. FIG. 10(*a*) shows the charging capacity, while FIG. 10(*b*) shows the discharging capacity of an amplifier, and in the prior art example of FIG. 9, the amplifiers B1, B2, and B4 have the configuration of FIG. 10 (*a*), while the amplifiers B3 and B5 of FIG. 9 have the configuration of FIG. 10 (*b*). The power supply voltages are the maximum potential within the circuit (VLCD) and the minimum potential (GND). FIG. 7(*c*) is a specific example of segment output waveforms for display and non-display that are repeated. If the time when the common selection level is the maximum drive potential V1 is frame 1 and the time when the common selection level is the minimum potential GND is frame 2, during frame 1 the segment is selected between V4 and GND, while during frame 2 the segment is selected between V1 and V3. If we observe one segment, this segment has n intersections between n commons, meaning that it has n display pixels (capacitances) with respect to common. Because only a single common outputs a selection level during a given frame, only one terminal that is different from the above-noted pixel capacitance segment is shorted to common, with the remaining n−1 being shorted to the non-selected level. FIG. 8(*a*) illustrates the condition of the current flow in the power supply that outputs the voltage levels V1 and V3 when the common and segment drivers operate, in the power supply that is shown in FIG. 9, when the frame 2 operation of FIG. 7 (*c*) is done. Here, if the capacitances CL1 and CL2 per pixel are Cp, CL1=(n−1)×Cp and CL2=Cp. As the panel becomes larger (that is, as n increases), the load capacitance increases, this leading to an increase in the equivalent capacitance at each level, making it necessary to lower the output impedance sufficient so that it is possible to provide sufficient drive for the capacitive load. However, with the reduction of power consumption equipment using liquid-crystal displays in recent years, even the bias current becomes significant.

For example, in the case in which the resistors R1 through R5 are 500kΩ, for VI1=10 V, the idling current flowing in the resistances can be limited to 10 V/(500kΩ×5)=4$\mu$A. However, in the differential and output stages of the amplifiers of FIG. 10(*a*) and FIG. 10(*b*), in the bias current is 1 $\mu$A, the overall amplifier bias current in the power supply circuit is (1+1)×5=10 $\mu$A. This current flows even when a load is not being driven, and is thus wasteful, and this has represented a technological problem with the move to lower power consumption in drive power supplies in recent years.

In this type of circuit, because charging and discharging by the amplifier of the liquid crystal load is performed between the internal circuit maximum potential (VLCD) and minimum potential (GND), regardless of the voltage level to which charging and discharging is done, this is basically merely discharging via the MOS output stage of the amplifier to the maximum potential (VLCD) or the minimum potential (GND) and this circuit does not make re-use of load current. However, according to an example of prior art as disclosed in Japanese Unexamined Patent Publication (KOKAI) No.5-257121, as shown in FIG. 11, there is a circuit that takes each of the potentials that are divided by resistors as the power supply voltages of the amplifiers. In this circuit, the current from an amplifiers flows into divided resistances, this resulting in a deterioration of display quality according to level change. Because the amplifier power supply has an impedance of 5 kΩor greater (in the prior art example, R1 is 5 kΩto 15 kΩ), not only does the output impedance (sum of the power supply impedance and on resistance of the output buffer) rise to greater than the divider resistances, but also the high power supply impedance results in unstable amplifier operation, due to noise, for example. If the output impedance of the amplifier is limited, there is a reduction in the above-noted divider resistances, so that the current flowing therein rises, the result being the problem of an increase in current consumption greater than the amplifier.

Accordingly, it is an object of the present invention to improve on the above-noted drawbacks in the prior art by providing a novel liquid-crystal drive power supply circuit which limits the current consumption more than in a liquid crystal drive power supply of the past, while making re-use of the charge that is charged and discharged when a load is driven so as to limit the current consumption during operation, the output level of the amplifier not being caused to vary and the output impedance being lowered so as to improve the quality of the display. Another object of the present invention is to provide a method of reducing the current consumption in the above-noted liquid-crystal drive power supply circuit.

SUMMARY OF THE INVENTION

In order to achieve the above-noted object, the present invention adopts the following basic technical constitution.

Specifically, the first aspect of a liquid-crystal display panel drive power supply circuit according to the present invention is a liquid-crystal display panel drive power supply circuit having a first power supply of a high potential, a second power supply of a potential that is lower than the potential of the first power supply, a plurality of voltage-dividing resistors provided in series between the above-noted first power supply and second power supply, and a plurality of voltage-follower configured amplifiers for introducing a plurality of differing voltages from the connection points between the above-noted resistors to a liquid-crystal display panel, wherein a capacitor is connected between an output terminal of each of the above-noted amplifiers and the second power supply.

In the second aspect of the present invention, the output voltage of an amplifier that outputs an output voltage to an output terminal that is higher than the output voltage of the amplifier is taken as the first power supply means, and the output voltage of an amplifier that outputs an output voltage to an output terminal that is lower than the output voltage of the amplifier is taken as the second power supply means.

In the third aspect of the present invention, the output voltage of an amplifier that outputs an output voltage to an output terminal that is higher than the output voltage of the amplifier is taken as the first power supply means and the output voltage of an amplifier that outputs a voltage to an output terminal that is the lowest among the amplifiers that output voltages that are higher than the output voltage of the amplifier is taken as the first power supply means, while the output voltage of an amplifier that outputs an output voltage to an output terminal that is lower than the output voltage of the amplifier is taken as the second power supply means and the output voltage of an amplifier that outputs a voltage to an output terminal that is the highest among the amplifiers that output voltages that are lower than the output voltage of the amplifier is taken as the second power supply means.

In the fourth aspect of the present invention, the output voltage of an amplifier that outputs an output voltage to an output terminal that is higher than the output voltage of the amplifier is taken as the first power supply means and the output voltage of an amplifier that outputs a voltage to an output terminal that is not the lowest among the amplifiers that output voltages that are higher than the output voltage of the amplifier is taken as the first power supply means, while the output voltage of an amplifier that outputs an output voltage to an output terminal that is lower than the output voltage of the amplifier is taken as the second power supply means and the output voltage of an amplifier that outputs a voltage to an output terminal that is not the highest among the amplifiers that output voltages that are lower than the output voltage of the amplifier is taken as the second power supply means.

In the fifth aspect of the present invention, the above-noted amplifier is configured by MOS transistors, which are formed on a substrate which is separated by a dielectric.

In the sixth aspect of the present invention, the above-noted amplifier is configured by MOS transistors, which are formed on an SOI substrate.

An aspect of a method of reducing the current consumption in a liquid-crystal display panel drive power supply is a method for reducing the current consumption in a liquid-crystal display panel drive power supply circuit having a first power supply of a high potential, a second power supply of a potential that is lower than the potential of the first power supply, a plurality of voltage-dividing resistors provided in series between the above-noted first power supply and second power supply, and a plurality of voltage-follower configured amplifiers for introducing a plurality of differing voltages from the connection points between the above-noted resistors to a liquid-crystal display panel, wherein a capacitor is connected between an output terminal of the above-noted amplifier and the second power supply, and a charge that is temporarily stored in this capacitor is re-used as the power supply of another amplifier of these amplifiers, thereby reducing the power consumption.

Embodiments of a liquid-crystal display panel drive power supply according to the present invention can be described with reference to accompanying drawings.

Referring to FIG. 1, in an embodiment of the present invention, in a multi voltage level output power supply circuit for driving a liquid crystal, this being formed by amplifiers (buffers) having an output impedance sufficient to drive a liquid crystal by inputting voltages that are divided by the resistive voltage divider formed by R1 through R5, which divides the voltage between the maximum potential (VI1) and the minimum potential (GND) for operating the liquid crystal, capacitors (C1 through C5) are inserted between the output of each amplifier and an internal circuit potential (GND or VLCD) so as to stabilize the level, and reduce the impedance. The output of an amplifier that outputs a voltage that is higher than this stabilized amplifier output voltage (hereinafter referred to as the high-potential level) is taken as the upper power supply, and the output of an amplifier that outputs a voltage that is lower than the above-noted output (hereinafter referred to as the lower-potential level) is taken as the lower power supply.

Next, the operation of the above-noted power supply circuit will be described, with reference to FIG. 1.

In a circuit of the prior art (FIG. 9), regardless of the output voltage level of the amplifier, a bias current flows within the circuit, from the maximum potential (VLCD) to the minimum potential (GND). The load drive by the output stage is merely one of discharging a charge stored in the load to the minimum potential (GND) or charging the load to the maximum potential (VLCD), with each amplifier consuming current independently. In the present invention, however, because the amplifier power supply is taken as higher than and lower than the output of a given amplifier, the bias current in the highest-order amplifier A1, which has the maximum potential (VLCD) and V2 potential as power supply voltages, flows into the V2 voltage level and is temporarily stored in capacitor C2. In the intermediate potential amplifier A3, because the power supply voltages are V2 and V4, the current that flows into the above-noted V2 voltage level is again stored in the V4 level capacitor C4. Because V4 is the power supply of the minimum-potential amplifier A5, this charge can be used again for the bias current of the minimum-potential amplifier A5. Simultaneously with this, the amplifier A4 can make re-use of the bias current consumed at A2.

In addition to the bias currents, in contrast to the prior art example of FIG. 9, in which the currents (charges) that are consumed in each of the amplifiers in driving the loads are not derived by charging and discharging of the loads to maximum and minimum potentials, each level charge is used, enabling re-use as described with regard to the bias current. By means of charge distribution between the various level capacitors and load capacitances, charges are reclaimed by each level capacitor, enabling their re-use as amplifier currents.

DESCRIPTION OF THE PREFERRED EMBODIMENTS

Embodiments of the present invention are described in detail below, with references being made to relevant accompanying drawings.

Figure 1:
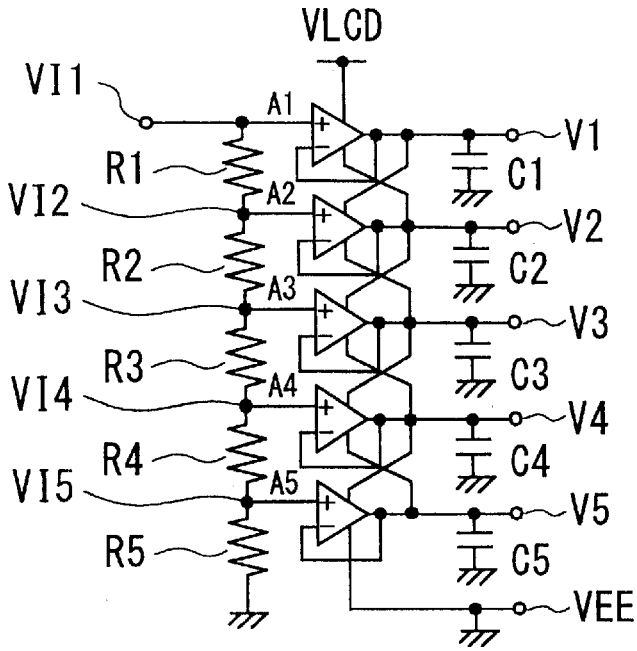
FIG. 1 is a circuit diagram of an embodiment of a liquid crystal drive power supply circuit according to the present invention.

FIG. 1 is a drawing that shows the specific structure of an embodiment of a liquid-crystal display panel drive power supply circuit according to the present invention. This drawing shows a liquid-crystal display panel drive power supply circuit that has a first power supply VI1 of a high potential, a second power supply VEE that is lower potential than the power supply VI1, a plurality of resistors (R1 through R5) that are connected in series between the first power supply VI1 and the second power supply VEE, and a plurality of voltage-follower configured amplifiers (A2 through A5) for the purpose of introducing to a liquid-crystal display panel the plurality of voltages VI2, VI3, VI4, and VI5 that are mutually different obtained at the connection points between the above-noted resistors (R1 through R5). In this circuit, capacitors (C2 through C4) are inserted between the output terminals of each of the amplifiers (A2 through A5) and the second power supply VEE.

In this circuit, the first power supply means of the amplifier A3 is taken as the output voltage V2 of the amplifier A2 that outputs to an output terminal an output voltage that is higher than the output voltage V3 of the amplifier A3, and the second power supply means of the amplifier A3 is taken as the output voltage V4 of the amplifier A4 that outputs to an output terminal an output voltage that is lower than the output voltage of the amplifier A3.

Next, a specific example of the present invention will be described in further detail.

Figure 4A:
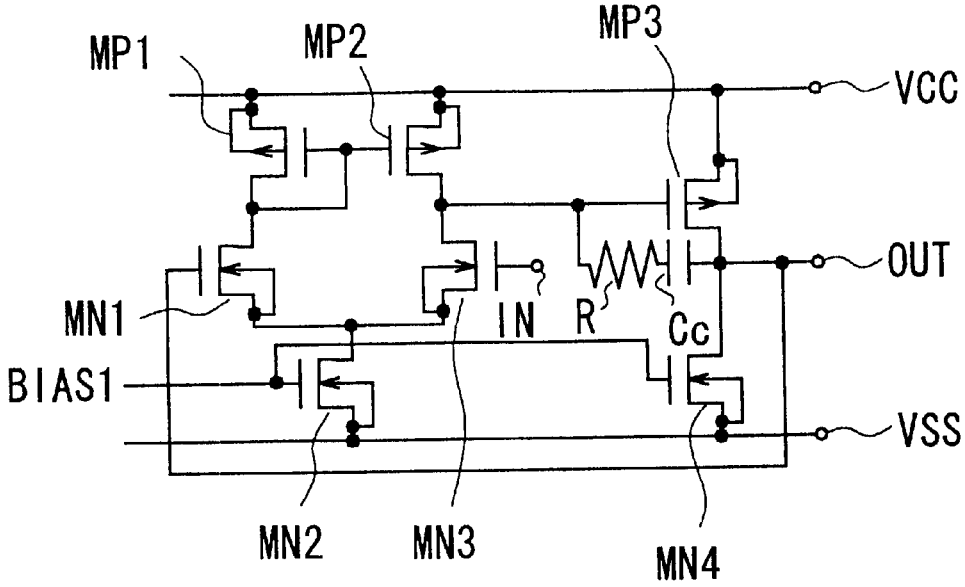
FIGS. 4(*a*) and 4(*b*) are circuit diagrams of an amplifier that is used in FIG. 1.
Figure 4B:
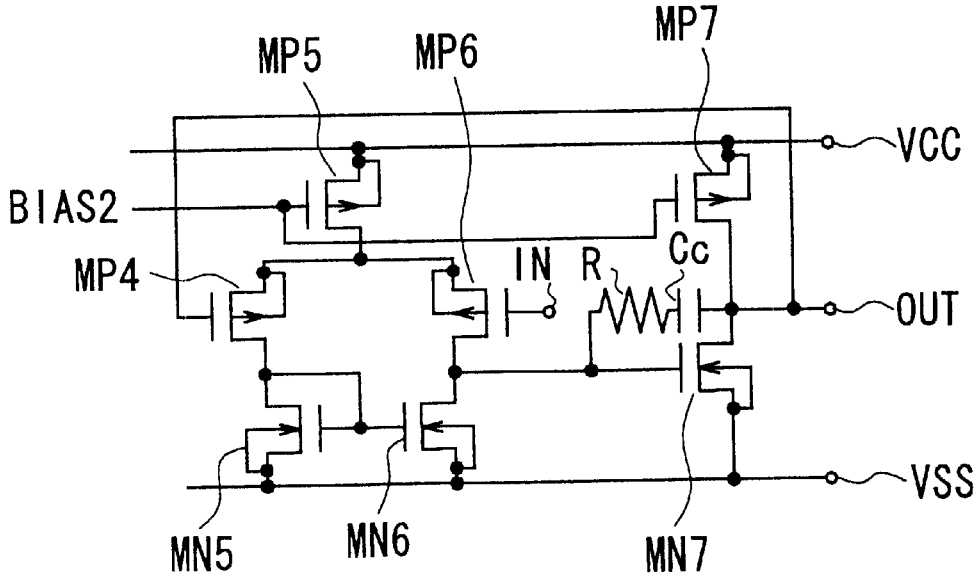
Figure 5A:
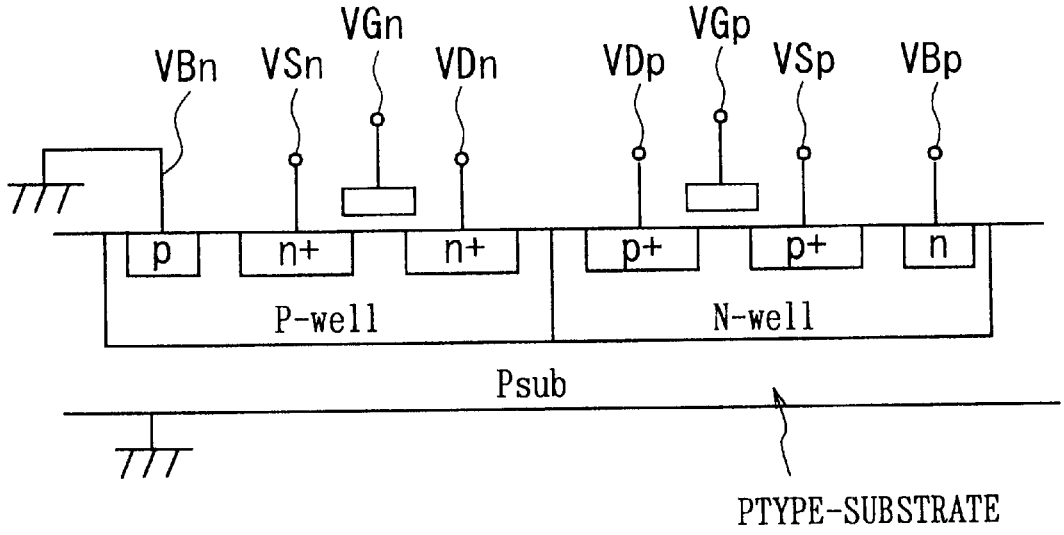
FIG. 5(*a*) is a cross-section view of a MOS structure (junction separation) in the process in the past, and FIG. 5(*b*) is a cross-section view of a MOS structure that is used in the present invention.
Figure 5B:
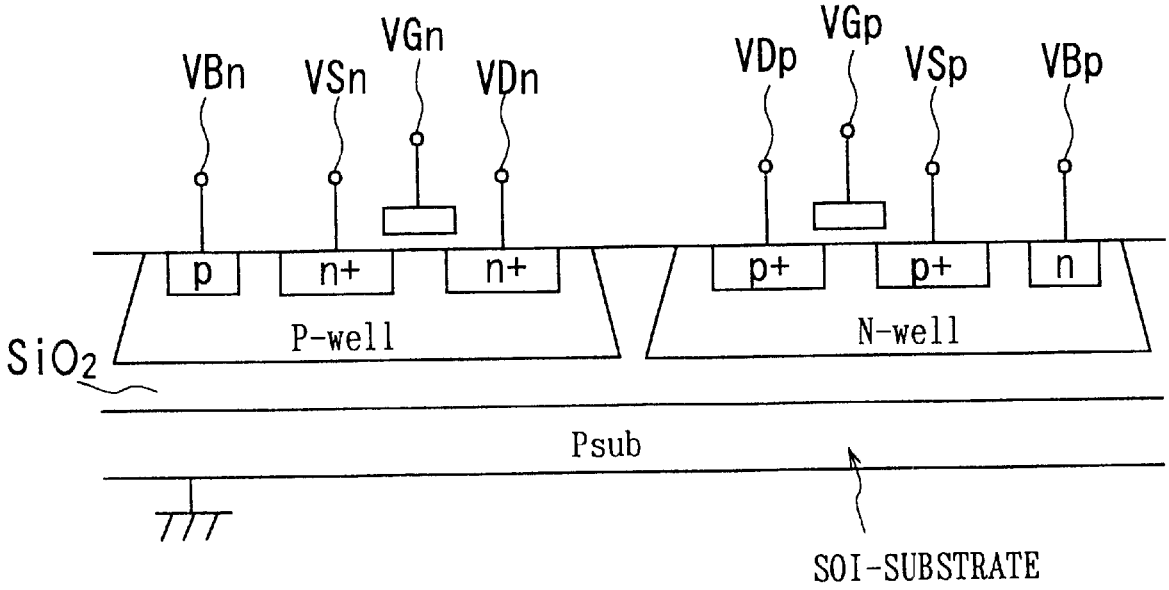
Figure 6:
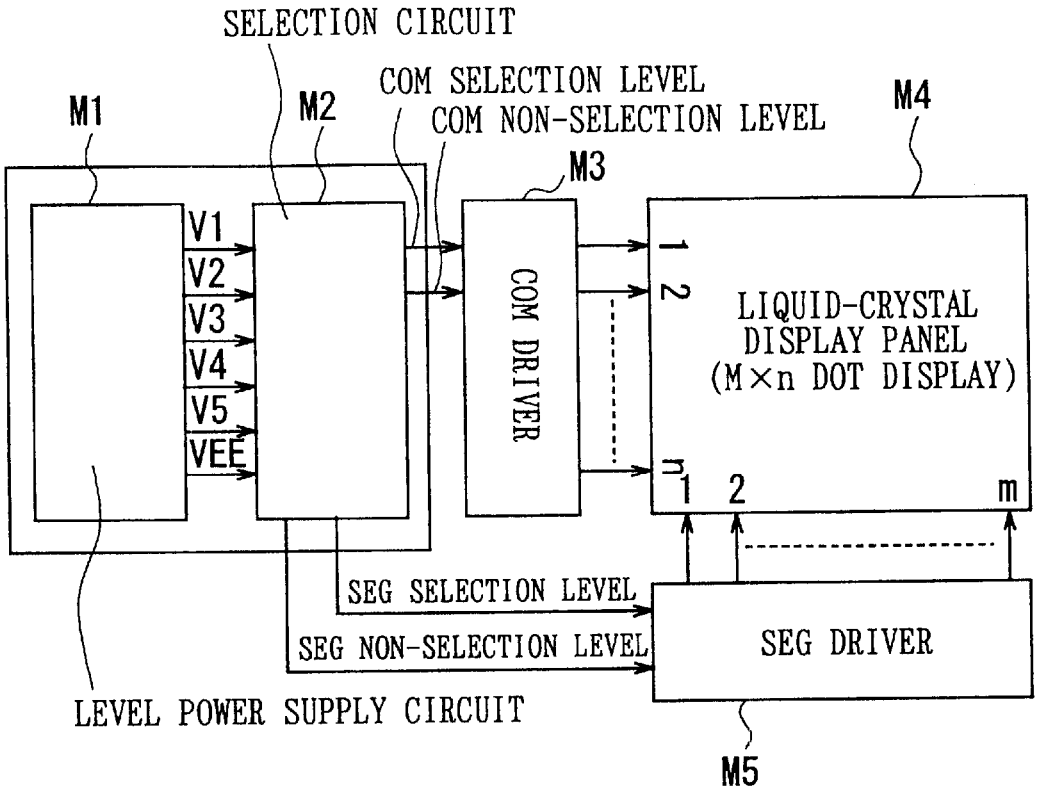
FIG. 6 is a block diagram that shows a general liquid-crystal panel drive power supply circuit which includes a liquid-crystal panel.

Referring to FIG. 1, the dividing circuit formed by the resistors R1 through R5 divides the maximum drive potential (VI1). In general, the values of the resistors R1 through R5 are selected in the range of several tens of kilohms to several hundreds of kilohms, so that wasteful idling current does not flow. Next, buffer amplifiers (A1 through A5) which receive these voltage levels and are capable of driving the liquid crystal load lower the output impedance. Capacitors C1 through C5 are added to the outputs of the buffer amplifiers A1 through A5, respectively, thereby stabilizing the level lowering the impedance, while also storing the inflowing charges thereto. In order that there is no problem with use as power supplies for the various voltage level amplifiers (A2 through A5) and in order to not influence the drive of the panel loads (20,000 to 40,000 pF for a 100×100 dot panel), these capacitors are set to values in a range from several tens of times to several thousands of time the overall panel capacitance, this being approximately 0.1 $\mu$F to several tens of $\mu$F. The amplifiers A1 through A5 are the amplifiers that are shown in FIG. 4(*a*) and FIG. 4(*b*). From the segment waveforms and common waveforms of FIG. 7, it can be seen that the V1, V2, and V4 levels, with the exception of the time when switching between frames, mainly need the capacity to charge the liquid crystal load (that is, raise the voltage thereon), while the V3 and V5 levels mainly need the capacity to discharge (that is lower the voltage). For this reason, the amplifiers A1, A2, and A4, as shown in FIG. 4(*a*), are configured so that the output stage having a p-channel MOS. The amplifiers A3 and A5, as shown in FIG. 4(*b*) are configured so that the output stages having an n-channel MOS. Except for the current capacity required by these amplifiers, a fixed bias current is caused to flow, so as to limit the current. In order to use amplifiers the upper potential output voltages and lower potential output voltages of each of the amplifiers A1 through A5 as power supply voltages, by using a total well-separated process (such as an SOI process), such as is shown in FIG.5(*b*), the design being such that normal amplifier operation is possible even with an intermediate potential used as a power supply without back gate effect of MOS transistor.

Next, actual waveforms and the operation of each amplifier will be described.

Figure 7A:
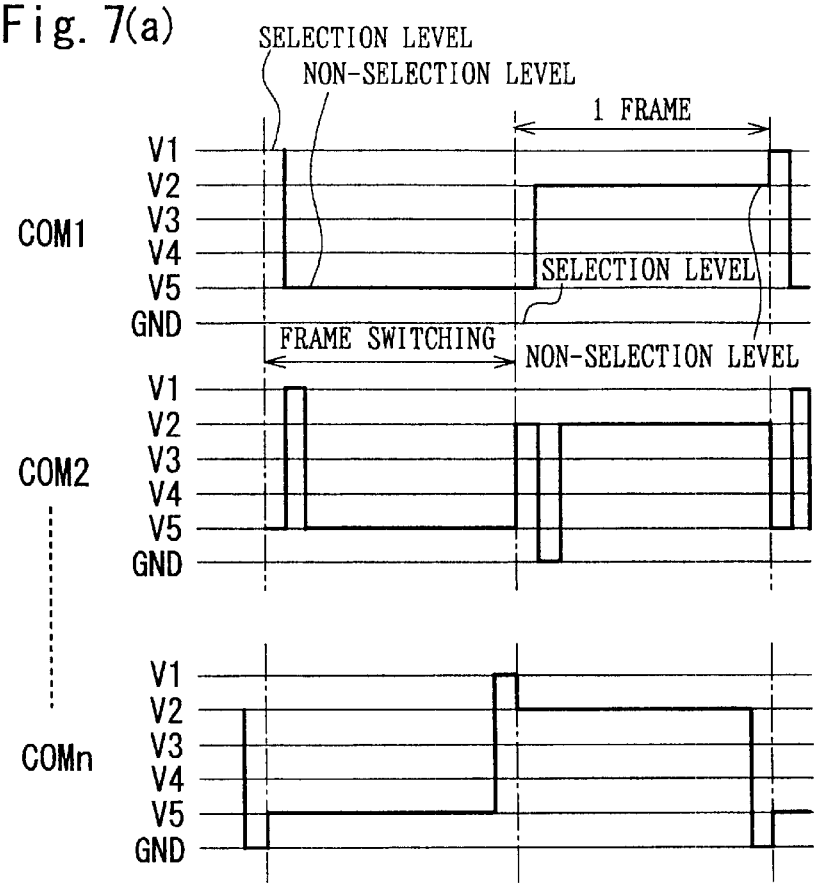
FIG. 7 is a drawing that shows liquid crystal drive waveforms, (a) showing the common output waveform, (b) showing the segment output waveform, and (c) showing the segment waveform for alternation between display and non-display.
Figure 7B:
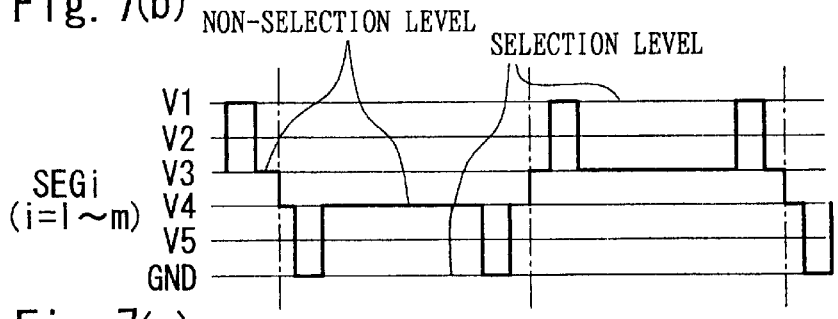
Figure 7C:
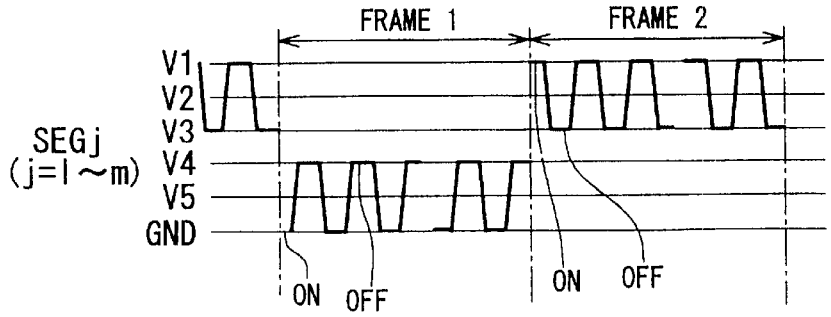
Figure 8A:
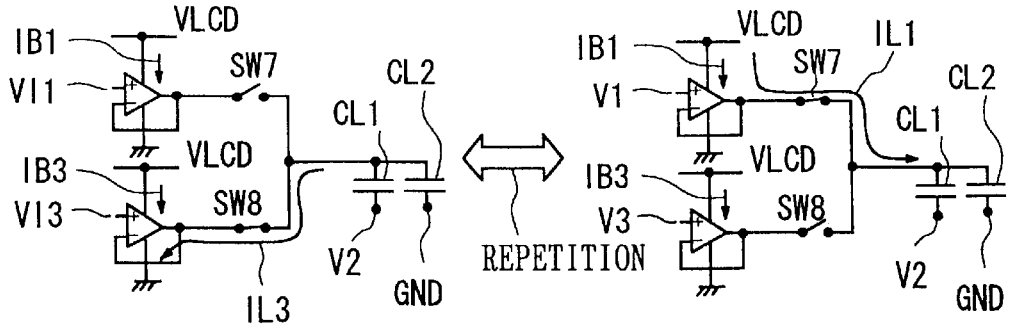
FIG. 8(*a*) is an equivalent circuit diagram for the condition of driving a liquid crystal load using a circuit of the past (for frame 2, segment selected), FIG. 8(*b*) is an equivalent circuit diagram for the condition of driving a liquid crystal load using this circuit (for frame 2, segment selected), and FIG. 8(*c*) is an equivalent circuit diagram for the condition of driving a liquid crystal load using this circuit (for frame 1, segment selected).
Figure 8B:
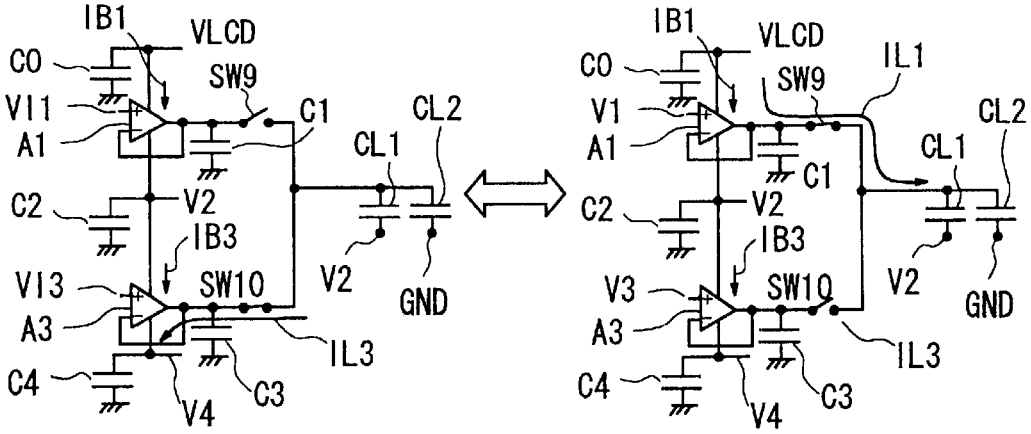
Figure 8C:
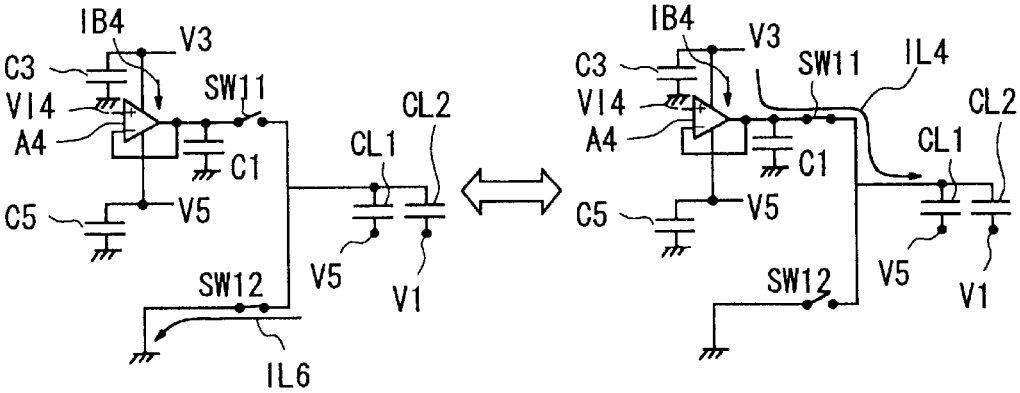
Figure 9:
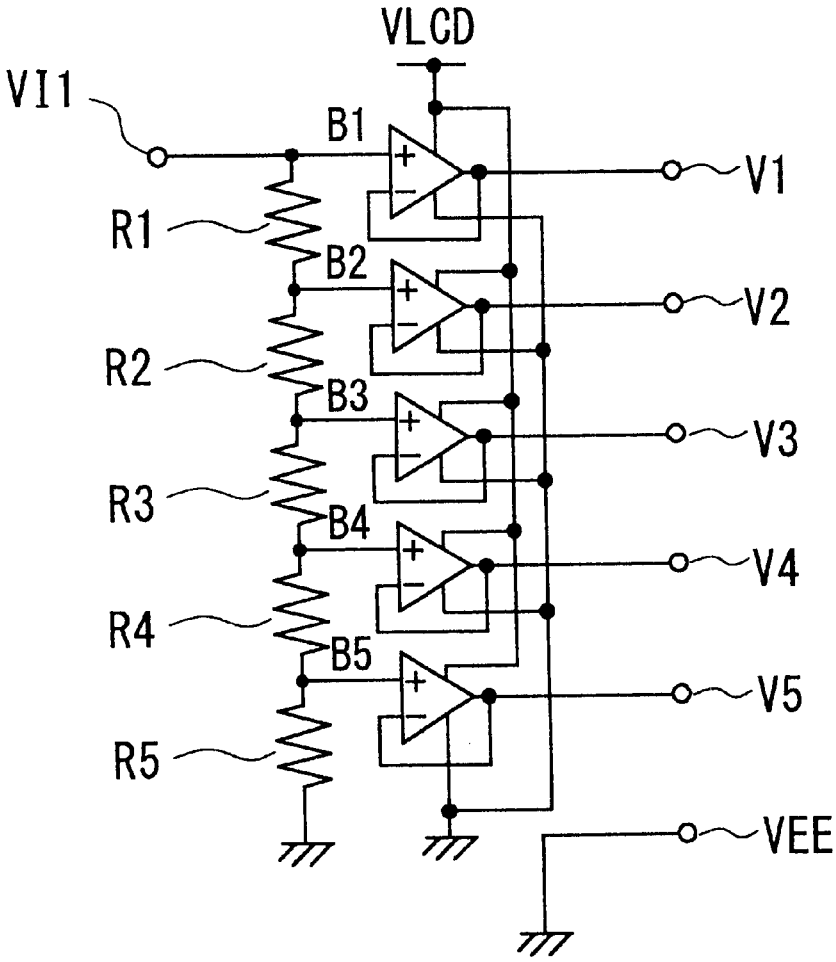
FIG. 9 is a circuit diagram of the prior art.
Figure 10A:
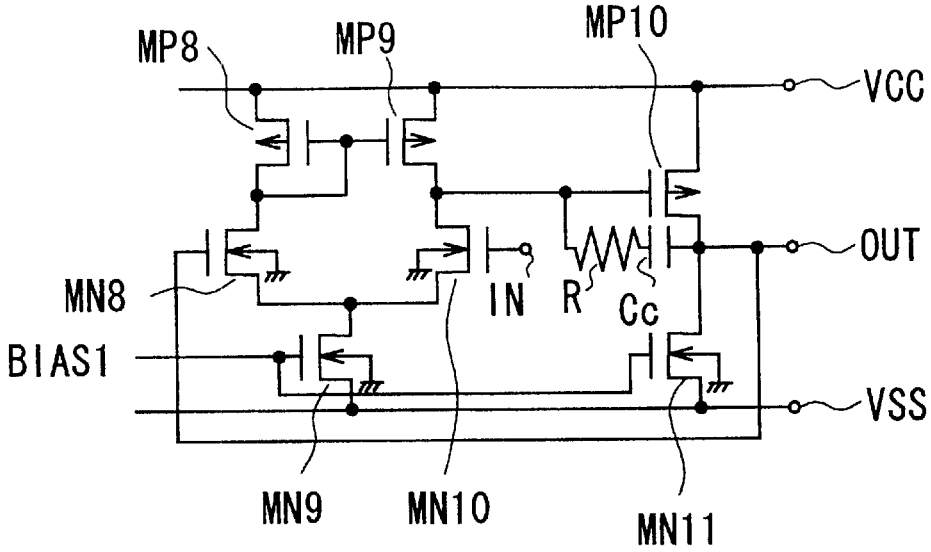
FIGS. 10(*a*) and 10(*b*) are a circuit diagram that shows the configuration of an amplifier used in the prior art.
Figure 10B:
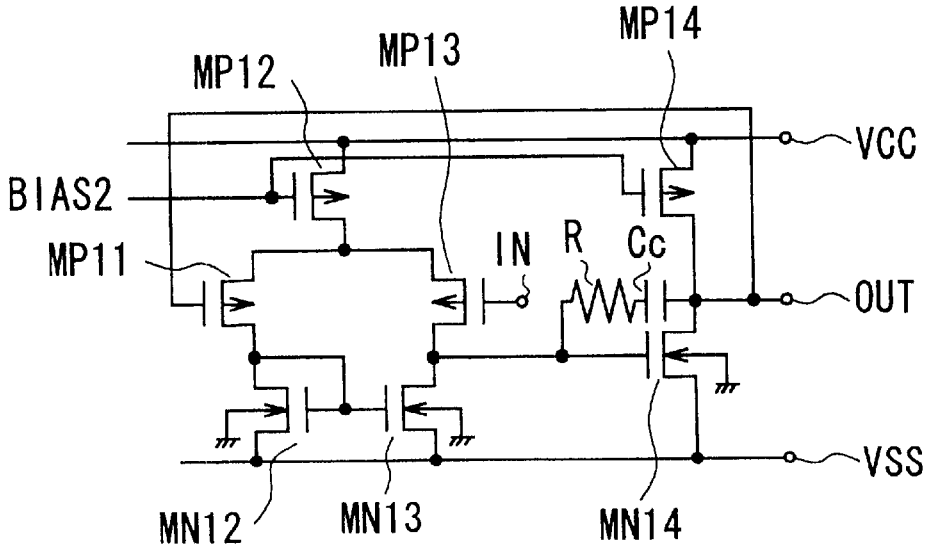
Figure 11:
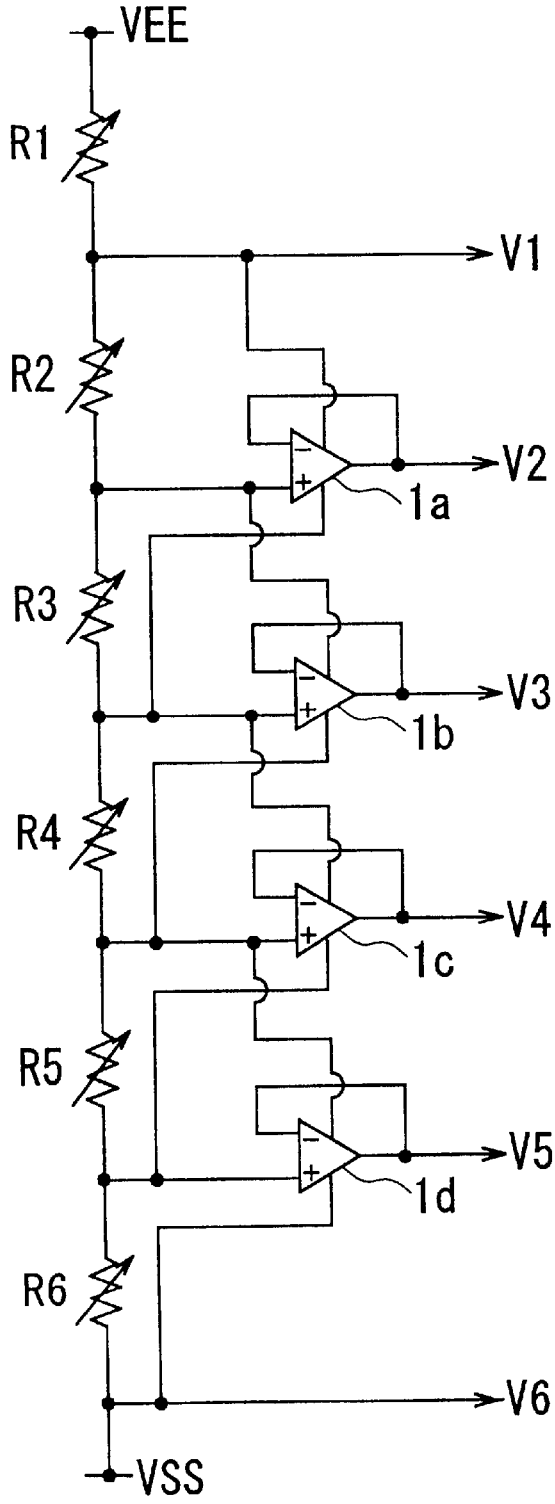
FIG. 11 is a circuit diagram that shows another example of prior art.

An example of the liquid crystal operating waveforms is shown in FIG. 7. The common output outputs a selection level sequentially starting with COMi (V1 for frame 1 and GND for frame 2) and, with the exception of the one common that is outputting the selection level, all the other commons are at the non-selection level (V5 for frame 1 and V2 for frame 2), thereby causing display line scanning. The segment line output a selection level (GND for frame 1 and V1 for frame 2) or a non-selection level (V4 for frame 1 and V3 for frame 2), depending upon the existence or non-existence of display at a dot of a scanned common line, thereby displaying the desired pixels at the intersections of the common and segment lines. The description that follows will be for the condition in which the most current is consumed by the liquid crystal drive power supply, this being the one in which the display and non-display conditions alternate. In this case, the common waveform is as shown in FIG. 7(*a*), and the segment waveform is as shown in FIG. 7(*c*). Just one common at a time is selected, regardless of the display status, with the remaining common waveforms being the non-selected waveform. Therefore, as seen from the segment output, if the liquid crystal load capacitance for one pixel that is formed at the intersection of a common line and a segment line is Cp, at each segment terminal there is a pixel capacitance for the number of common lines, this being Cp×n, one end of one capacitance load being connected to the common selection level (GND for frame 1 and V1 for frame 2), with the other (n−1) capacitance loads outputting the non-selected level (V2 for frame 1 and V5 for frame 2). The equivalent operation, which includes the panel load and switches of the peripheral circuitry under above noted conditions is shown in FIGS. 8(*b*) and (*c*). FIG. 8(*b*) shows the condition of a segment changing as in FIG. 7(*c*) at the time of frame 2. The left part of FIG. 8(*b*) shows the condition in which a non-displayed dot is output, while the right part of FIG. 8(*b*) shows the condition in which a displayed dot is output. The left part of FIG. 8(*c*) shows the condition for a display point at the time of frame 1, while the right part of FIG. 8(*c*) shows the non-display condition. CL2 is equal to the Cp at the selected pixel. Because CL1 represents the pixels that occur between the remaining non-selected common outputs and one segment, this is equal to (n−1)×Cp. IB1 through IB4 are the bias currents that flow in each of the level amplifiers. In general normal operation of the amplifiers required several μA of current flow. To simplify the description, the amplifier bias current IB1 to IB4 will be taken as approximately equal currents. (In general, the bias currents are, by virtue of a current mirror circuit or the like, nearly the same values, and even in the case in which they differ, the only effect in this circuit would be the inability to use the difference components between the bias currents.) In FIG. 8(*b*), the bias current IB1 that flows into the amplifier A1 flows into V2, which is the power supply of the amplifier A3, and is stored in the capacitor C2. Because the amplifier A3 uses V2 as the upper potential power supply, the bias current IB3 is consumed from V2. In this condition, the current IB1 flows into the capacitor C2 that is connected to V2, and the current IB3 flows outward. As defined above, in the case of IB1=IB3, because the idling current consumed by IB1 is used to operate amplifier A3, whereas in the past the current consumption at steady state was IB1+IB3, it is just IB1. The bias current IB3 that flows into the amplifier A3 flows into the lower potential powers supply V4 and the capacitor C4, so that, as can be seen from FIG. 1, this can be re-used as the bias current that is consumed by amplifier A5. That is, the bias current that was consumed by the amplifier A1 is re-used by the amplifiers A3 and A5. In the same manner, the current that was consumed by the amplifier A2 can be re-used by the amplifier A4, so that, in contrast the prior art, in which the steady-state current consumption for the case of common amplifier bias currents (i.e., when IB1=IB2= . . . =IB) was 5 ×IB, with the circuit of the present invention, it is just IB1+IB2=2×IB (an approximate 40% reduction in current consumption). From the right part of FIG. 8(*b*), at the time of frame 2, the liquid crystal load drive current IL1 from the amplifier A1 is reclaimed in the V4 level capacitor(C4) by the amplifier A3 discharge drive current IL3, enabling its re-use. In reality, because the amplifier A4 is configured as shown in FIG. 4(*a*), the bias current, which is established by a bias voltage, flows also in the output stage. For this reason, the reclaimed current exhibits a commensurate loss. IL4 can be made to capture this loss, and is very small compared to the current required for actual load drive. In the past, because a charge to the load by amplifiers A1 and A3 with respect to one segment was discharged via A3 or GND level, the current consumption that was required for load drive (during two frames, with the exception of when switching frames) was IL1+IL3, with the circuits of FIG. 1 and FIG. 8, this is only IL1+(the bias current of the amplifier A4 output stage). In general, when the fact that the load drive current is larger than the idling current (several μA or several hundreds of μA to current for a load of several tens of pF to several thousands of pF) and the fact that there is not much difference in the current consumption with the panel and frames (there being only a change in polarity), even in the case of 1 segment, the panel load drive current is reduced from the IL1+IL3 of the past to approximately IL1, this being an approximate halving of the current. While the above is with regard to the segment output level only, with regard to the current consumptions at each level at the time of frame switching, because the frequency is 1/n (where n is the number of common lines, this being several tens to several hundreds) with respect to frequency of the segment waveform, the current consumption with respect to a segment change as a current consumed to drive the panel load is 1/n the current consumed, this representing a great reduction. Because the various level capacitors serve to lower the impedance of V1 through V5 as power supplies for the various amplifiers, and because the amplifier circuits are configured so as to be independent of substrate potential, by using a stabilized intermediate potential obtained by the capacitor as an amplifier power supply, the output impedance increase is limited, and it is possible to achieve a power supply circuit having approximately 50% of the current consumption, while maintaining the display quality of the past.

In the case in which an amplifier circuit is implemented with MOS transistors, because an intermediate level is used as a power supply, the maximum potential (VLCD) or minimum potential (GNP) within the circuit, which is the difference in potential between the wafer substrate and the source potential of the power supply of the MOS transistor causes a shift in the MOS transistor threshold (VT), this being known as the back-gate effect. Because of this, a process which uses a SOI (silicon on insulator substrate), which enables free selection of the well potential so as to prevent the amplifier from not operating, or a process in which the well is separated by a dielectric is used.

In the above-noted case, it is possible to freely set the back-gate (well) potential, so that by making the source potential common with the back-gate potential, amplifier instability caused by, for example, a shift in the threshold voltage caused by the back-gate effect resulting from sub-potentials and MOS source potentials (well potentials) as in the processes of the past can be prevented.

The configuration of the circuit of FIG. 1 is such that the output voltage of an amplifier that outputs an output voltage to an output terminal that is higher than the output voltage of the amplifier is taken as the first power supply and the output voltage of an amplifier that outputs a voltage to an output terminal that is the lowest among the amplifiers that output voltages that are higher than the output voltage of the amplifier is taken as the first power supply, while the output voltage of an amplifier that outputs an output voltage to an output terminal that is lower than the output voltage of the amplifier is taken as the second power supply and the output voltage of an amplifier that outputs a voltage to an output terminal that is the highest among the amplifiers that output voltages that are lower than the output voltage of the amplifier is taken as the second power supply.

Figure 2:
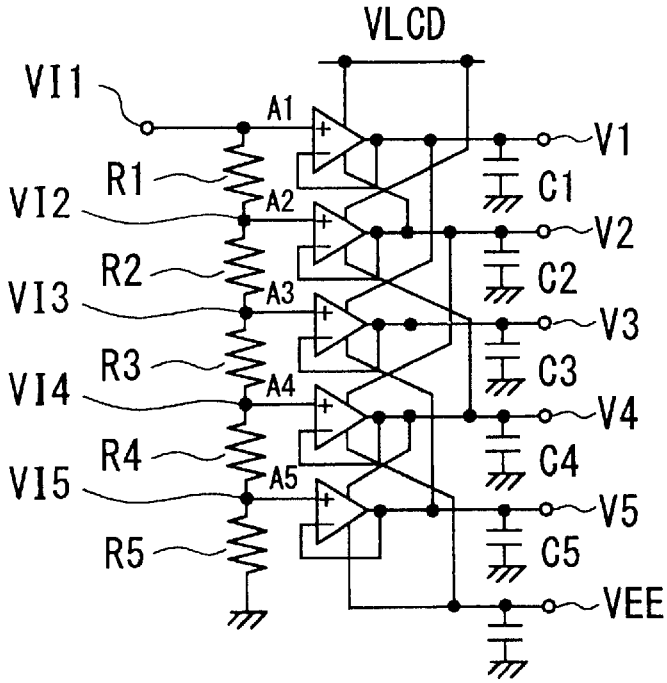
FIG. 2 is a circuit diagram of another embodiment of the present invention.
Figure 3:
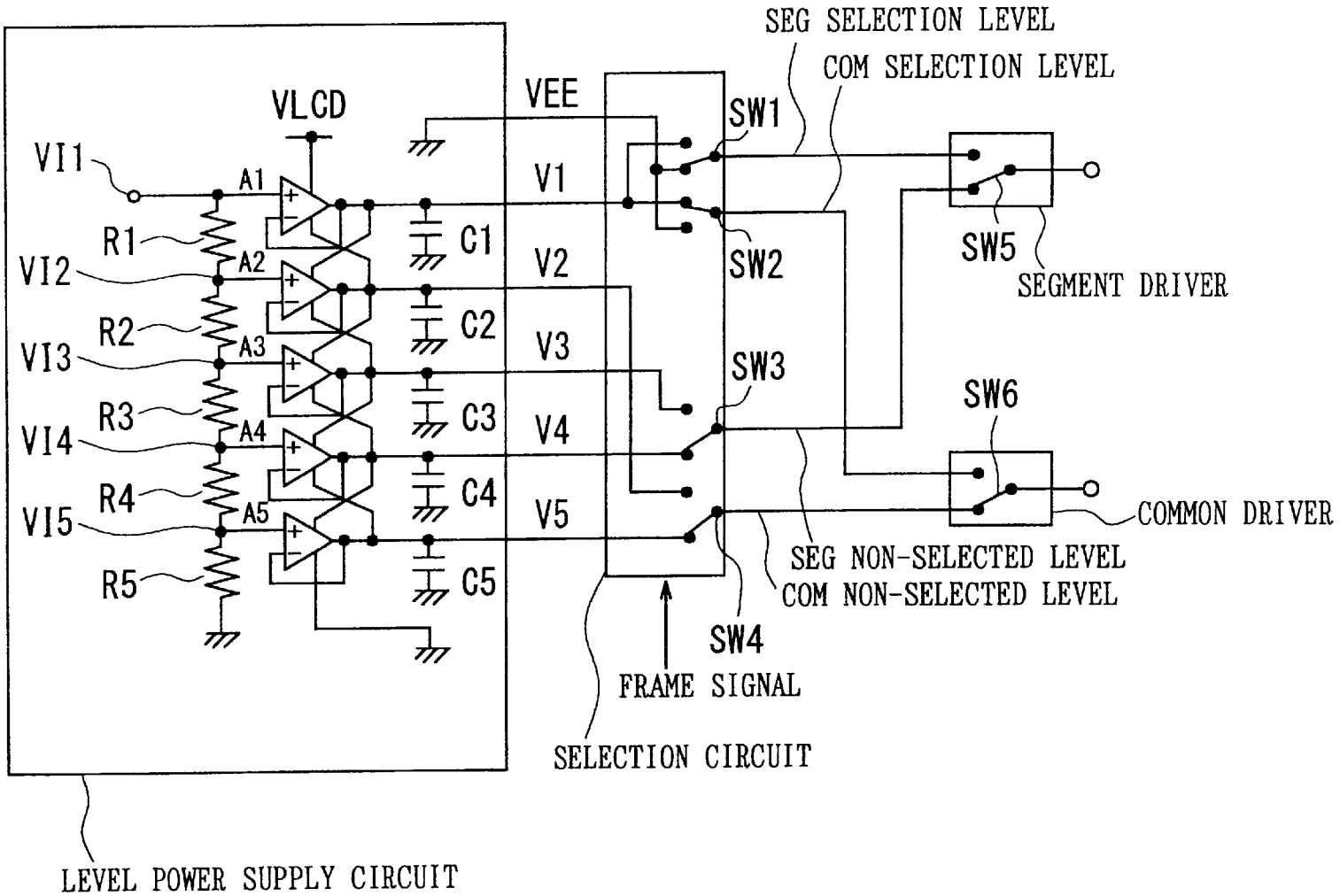
FIG. 3 is a circuit diagram which includes peripheral circuitry.

In contrast to the above, the configuration of the circuit of FIG. 2 is such that the output voltage of an amplifier that outputs an output voltage to an output terminal that is higher than the output voltage of the amplifier is taken as the first power supply and the output voltage of an amplifier that outputs a voltage to an output terminal that is not the lowest among the amplifiers that output voltages that are higher than the output voltage of the amplifier is taken as the first power supply, while the output voltage of an amplifier that outputs an output voltage to an output terminal that is lower than the output voltage of the amplifier is taken as the second power supply and the output voltage of an amplifier that outputs a voltage to an output terminal that is not the highest among the amplifiers that output voltages that are lower than the output voltage of the amplifier is taken as the second power supply. The object of the present invention is achieved by either of the above-noted circuit configurations.

By virtue of the above-described configuration of a liquid-crystal panel drive power supply circuit, the following effects are achieved.

(1) The bias current that is consumed in each of the level amplifiers is temporarily stored in a capacitor, and this is re-used as the power supply for a lower potential amplifier, thereby reducing the steady-state current consumption in comparison with liquid-crystal power supplies of the past.

(2) The electrical charge by virtue of a the drive currents at each level is temporarily stored in a capacitor, and this is then re-used to perform panel load drive for lower levels, thereby reducing the steady-state current consumption in comparison with liquid-crystal power supplies of the past.

What is claimed is:

1. A liquid-crystal display panel drive power supply circuit comprising:

a first power supply with a high potential, a second power supply with a potential that is lower than said first power supply potential, a plurality of voltage-dividing resistors provided in series between said first power supply and said second power supply, a plurality of voltage-follower configured amplifiers for introducing a plurality of differing voltages from connection points between said resistors to a liquid-crystal display panel, and capacitors connected between an output terminal of each of said amplifiers and said second power supply, a first of said amplifiers for outputting a first voltage that is used as a first power supply means, a second of said amplifiers for outputting a second voltage, and a third of said amplifiers for outputting a third voltage that is used as a second power supply means, wherein said first voltage is higher than said second voltage, said third voltage is lower than said second voltage, said first supply means is one potential supply means for said second amplifier that outputs a voltage less than said first voltage and greater than said third voltage, and said second power supply means is the other potential supply means for said second amplifier.

2. A liquid-crystal display panel drive power supply circuit comprising:

a first power supply with a high potential, a second power supply with a potential that is lower than said first power supply potential, a plurality of voltage-dividing resistors provided in series between said first power supply and said second power supply, a plurality of voltage-follower configured amplifiers for introducing a plurality of differing voltages from connection points between said resistors to a liquid-crystal display panel, and capacitors connected between an output terminal of each of said amplifiers and said second power supply, wherein a first power supply terminal of said amplifier is connected to an output terminal of another amplifier having an output potential that is higher than an output potential of said first amplifier, and a potential of said first power supply terminal is the lowest among amplifier output voltages that are higher than said output potential of said first amplifier, while a second power supply terminal of said first amplifier is connected to an output terminal of another amplifier having an output potential that is lower than said output potential of said first amplifier, and a potential of said second power supply terminal is the highest among amplifier output voltages that are lower than said output potential of said first amplifier.

3. A liquid-crystal display panel drive power supply circuit comprising:

a first power supply with a high potential, a second power supply with a potential that is lower than said first power supply potential, a plurality of voltage-dividing resistors provided in series between said first power supply and said second power supply, a plurality of voltage-follower configured amplifiers for introducing a plurality of differing voltages from connection points between said resistors to a liquid-crystal display panel, and capacitors connected between an output terminal of each of said amplifiers and said second power supply, wherein a first power supply terminal of said amplifier is connected to an output terminal of another amplifier having an output potential that is higher than an output potential of said first amplifier, and a potential of said first power supply terminal is not the lowest among amplifier output voltages that are higher than said output potential of said amplifier, while a second power supply terminal of said first amplifier is connected to an output terminal of another amplifier having an output potential that is lower than said output potential of said first amplifier, and a potential of said second power supply terminal is not the highest among amplifier output voltages that are lower than said output potential of said first amplifier.

4. The liquid-crystal display panel drive power supply circuit according to claim 1, wherein said amplifiers are implemented with MOS transistors, said MOS transistors being formed on a substrate that is separated by a dielectric.

5. The liquid crystal display panel drive power supply circuit according to claim 1, wherein said amplifiers are implemented with MOS transistors, said MOS transistors being formed on an SOI substrate.

* * * * *